United States Patent [19]

Kozuka et al.

[11] Patent Number: 4,457,099

[45] Date of Patent: Jul. 3, 1984

[54] TOY VEHICLE HAVING BODY CAPABLE OF VERTICAL MOVEMENT WITH RESPECT TO CHASSIS

[75] Inventors: Michihiro Kozuka; Masayuki Tonokura, both of Tokyo, Japan

[73] Assignee: Tomy Kogyo Co., Inc., Japan

[21] Appl. No.: 379,775

[22] Filed: May 19, 1982

[30] Foreign Application Priority Data

May 22, 1981 [JP] Japan ..... 56-74331

[51] Int. Cl.[3] ..... A63H 17/26

[52] U.S. Cl. ..... 446/437; 446/464; 446/466

[58] Field of Search ..... 46/201, 202, 206, 211, 46/209, 251, 208

[56] References Cited

U.S. PATENT DOCUMENTS 3,859,752 1/1975 Morrison et al. ..... 46/201

FOREIGN PATENT DOCUMENTS 933733 9/1955 Fed. Rep. of Germany ..... 46/206

*Primary Examiner*—Mickey Yu

*Attorney, Agent, or Firm*—K. H. Boswell; Edward D. O'Brian

[57] ABSTRACT

A toy vehicle has a body, and attached to the body is a chassis which is movably mounted thereon so as to move vertically up and down relative to the chassis. A motor is located within the vehicle and aside from propelling the vehicle forward over a support surface, the motor additionally drives a mechanism which raises and lowers the body relative to the chassis. When the body is raised relative to the chassis, the vehicle is propelled forward over the support surface by the motor; however when the body is lowered to the chassis, the drive connection between the driving wheel of the vehicle and the support surface is severed, inhibiting forward progress of the vehicle. The vehicle performs the above noted functions in a cyclic manner, repeating one after the other.

10 Claims, 9 Drawing Figures

TOY VEHICLE HAVING BODY CAPABLE OF VERTICAL MOVEMENT WITH RESPECT TO CHASSIS

BACKGROUND OF THE INVENTION

This invention is directed to a toy vehicle which is capable of having its body portion move upwardly and downwardly with respect to its chassis portion, in conjunction with the vehicle moving across a support surface.

A plurality of toy vehicles of all kinds of shapes and description are known. Generally, these toy vehicles are constructed to mimic actual vehicles utilized in the adult world. A certain percentage of the known toy vehicles are, however, constructed to differ significantly from the actual vehicle. This class of vehicles can generally be classified as "comic vehicles."

Among the comic vehicles known are vehicles such as are described in U.S. Pat. Nos. 1,663,169 and 1,979,242. Additionally, U.S. Pat. No. 1,577,743 describes an actual full-sized comic vehicle which is stated as being adapted for use in entertainment and exhibitions.

A different class of toy vehicles can generally be described as vehicles which have detachable or dislocatable parts. Thus, in this class of vehicles, upon contact with some sort of surface or the like, one or more parts of the vehicle become disengaged from other parts, or become rearranged in a different configuration from the normal configuration of parts. These types of vehicles generally are described by U.S. Pat. Nos. 3,176,429; 1,363,891; 1,546,431; 3,668,804; 1,288,813 and 3,859,752. Certain of this class of vehicles, such as the one described in U.S. Pat. No. 3,859,752, aside from being dislocatable with respect to its parts, also are somewhat comical in nature, incorporating absurd or distorted features thereon, rendering a comical appearance.

Generally, the dislocatable vehicles noted in the previous paragraph do not perform their function in a cyclic manner, that is, they must be preloaded, and then, upon striking a surface, they irreversibly move from one configuration to the next. They can only be returned to their original configuration by reassembling the component parts of the vehicle back to the original configuration via manual manipulation of these parts by the operator of the toy. Comic vehicles described in the paragraph above directed to these comic vehicles do perform cyclic functions. However, the cyclic functions which they perform are of a nature wherein they simply wobble while they move across a surface or they have one or more parts which move with respect to the remainder of the parts in a cyclic manner.

It is deemed that there exists a need for a comic type vehicle which has at least one or more parts which become dislocated or disoriented with respect to the remainder of the parts as do the dislocatable vehicles described in the paragraph above directed to this class of vehicles, but which will perform in a cyclic manner and do not require reassembly of the component parts by the operator of the vehicle but will automatically interchange between one configuration and another.

BRIEF DESCRIPTION OF THE INVENTION

It is a broad object of this invention to provide a vehicle as described in the previous sentence. It is a further object of this invention to provide a comic vehicle having a self contained power supply which, when activated, will cause the vehicle to move in a normal manner for a certain period of time, followed by the vehicle assuming an unnatural configuration for a second period of time and then resorting back to the normal mode of operation without operator interference or assistance. Furthermore, it is an object of this invention to provide a toy vehicle which is so engineered and constructed that it is extremely economical for the consumer, allowing for widespread distribution, but is engineered to yield a reasonable service life.

These and other objects, as will become evident from the remainder of this specification, are achieved in a toy vehicle which comprises a chassis means; a body means movably mounted on said chassis means so as to move vertically up and down relative to said chassis means; a motor means located in association with said chassis means; operating means mounted on said chassis means in operative association with said motor means and cyclically capable in a first instance of propelling said vehicle across a support surface and positioning said body means in one of a raised position and a lowered position relative to said chassis means, and in a second instance of maintaining said vehicle relatively stationary with respect to said support surface and positioning said body means in the other of said raised position and said lowered position relative to said chassis means.

In the preferred embodiment of the toy vehicle, the operating means would include a plurality of wheels which would be rotatably mounted to the chassis and including at least one of these wheels being a driving wheel which is operatively connected to the motor means and rotatable with respect to the chassis in response to rotary motion imparted to it by the motor means. Furthermore, the driving wheel would be capable of propelling the vehicle across a support surface in a first instance, with the body means located in a raised position with respect to the chassis.

Associated with the driving wheel would be a motion impeding means located such that, in the second instance, the motion impeding means impedes the motion of the vehicle with respect to the surface. Preferredly, the motion impeding means would allow operative contact of the drive wheel with the support surface in the first instance and, in the second instance, the impeding means would disengage the operative contact of the driving wheel with the support surface.

In the preferred embodiment, an elevating means would be included and would be operatively connected between the chassis means and the body means and would be capable of moving said body means with respect to said chassis means between said raised and said lowered positions. Preferredly, the body means would be divided into a body section and a left and right side ornamental wheel section. The ornamental wheel sections would be movable with respect to the body section and would be capable of assuming, in the first instance, an essentially vertical position with respect to the support surface to mimic the correct position of wheels on a normal vehicle, and in the second instance, to assume a prolapsed position with respect to the support surface, mimicking a disabled vehicle.

Preferredly, the impeding means would include a first lever means pivotally mounted on the chassis with one of its ends located in conjunction with the driving wheel such that this end is capable of moving upwardly and downwardly to contact the support surface to lift the driving wheel away from operative contact with the support surface and to allow the driving wheel to engage in operative contact with the support surface. Preferredly, the body section would be moved with respect to the chassis means by a second lever means pivotally mounted on the chassis and capable of raising and lowering the body section with respect to the chassis. The preferred form of this second lever means would be a bell crank which is pivotally mounted to the chassis about one of its ends and contacts the body section at a point proximal to the elbow of the bell crank.

Preferredly, a rotary means would be included in conjunction with the motor means and would have a first and second arcuately shaped contact surface located thereon with the bell crank contacting one of the arcuate surfaces and the first lever means contacting the other such that the bell crank and the lever means are moved with respect to the chassis as they follow the arcuate surfaces.

BRIEF DESCRIPTION OF THE DRAWINGS

This invention will be better understood when taken in conjunction with the drawings wherein.

Figure 1:
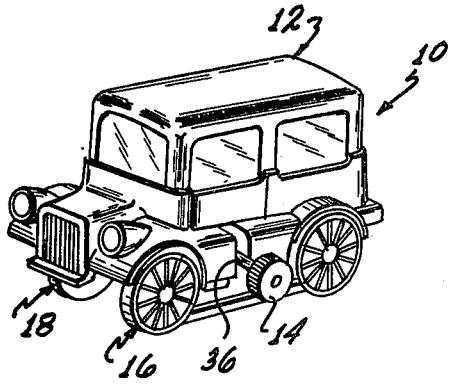
FIG. 1 is an oblique view of the preferred embodiment of the toy vehicle of the invention.

This invention utilizes certain principles and/or concepts as are set forth in the claims appended to this specification. Those skilled in the toy arts will realize that these principles and/or concepts are capable of being illustrated in a variety of embodiments. For this reason, this invention is not to be construed as being limited to the exact illustrative embodiment utilized herein, but is to be construed in light of the claims.

DETAILED DESCRIPTION OF THE INVENTION

In the Figs., an illustrative embodiment of the invention is illustrated by the vehicle 10. The vehicle 10 is constructed to mimic an old-time, or antique type car which performs a comic function. Several component parts can be seen in FIG. 1. These would include a body 12, a knurled knob 14 and a left side ornamental wheel section 16 as well as a right side ornamental wheel section 18. Both the left and right side ornamental wheel sections 16 and 18 are for appearance purposes only and do not form the actual supporting or driving wheels of the vehicle. The supporting and driving wheels of the vehicle are as seen in the other Figs. and would include a single front wheel 20 which is set at an angle such that the vehicle 10 does not travel in a straight line. The vehicle 10 is further supported by left and right rear wheels 22 and 24 which both support the vehicle in certain instances and provide the driving force to propel the vehicle across a support surface.

The vehicle is operated as follows. The knurled knob 14 is turned to wind up a spring motor 26 located inside the vehicle 10. The vehicle is then set on a support surface and it is driven forward by the rear wheels 22 and 24 for a period of time. During this period of time, the left and right side ornamental wheel sections 16 and 18 are in a position as is seen in FIG. 1. After a particular time period has expired, a lever 28 extends downwardly from the under side of the vehicle 10 and engages the support surface, lifting the right and left rear wheels 22 and 24 above its support surface, thus disengaging them and ceasing the forward motion of the vehicle 10. Concurrently, the body 12 of the vehicle 10 starts to descend downwardly with respect to the chassis 30. As the body 12 descends downwardly, the left and right side ornamental wheel sections 16 and 18 start spreading outwardly, as is evident from viewing FIG. 6*a*. When the body 12 is in its lower limit of travel with respect to the chassis 30 and the left and right side ornamental wheel sections 16 and 18 are prolapsed with respect to the support surface, the vehicle can assume somewhat of a comical appearance.

As the spring motor 26 continues to operate, the body 12 is then raised with respect to the chassis 30, drawing in the left and right side ornamental wheel sections 16 and 18 until they assume their upright configuration as is seen in FIGS. 1 and 17, and concurrently withdrawing the lever 28 upwardly into the chassis 30 allowing rear wheels 22 and 24 to once again contact the support surface, at which time the vehicle 10 again resumes forward motion. The vehicle 10 will continue going forward in a somewhat curved path because of the orientation of the front wheel 20 until once again the body section 12 starts to descend and the rear wheels 22 and 24 are lifted upwardly from the support surface.

The motor 26 is a typical spring wound motor housed in a motor case 32, which has an axle 34 on which the left and right rear wheels 22 and 24 are mounted. A shaft 36 extends into the motor case 32 and includes the knurled knob 14 on its end. The shaft 36 transmits rotation of the knurled knob 14 to wind the spring motor 26 and it also serves as an outer shaft which governs the functioning of the lever 28 and the raising and the lowering of the body 12.

Fixedly attached to shaft 36 is a member 38 having two spring arms collectively identified by the numeral 40. A disk member 42 has a plurality of holes collectively identified by the numeral 44. The ends of the spring arms 40 fit into the holes 44 and transmit rotation of the shaft 36 to the disk member 40 during counterclockwise rotation of the shaft 36 under the influence of the spring motor 26. During winding of the spring motor 26 however, clockwise rotation of the shaft 36 is not necessarily transmitted to the disk 42 if the disk 42 is refrained from turning by other components as hereinafter explained. During winding of the motor 26 the spring arms 40 can flex outwardly from the disk member 42, slipping out of the holes 44 such that clockwise rotation of the shaft 36 and the member 38 is not transmitted to the disk 42 because of slippage of the spring arms 40 with respect to the holes 44. Movement of the spring arms 40 with respect to the holes 44 also serves as an override mechanism to prevent damage to certain of the components of the vehicle 10 should the child playing with the vehicle 10 grasp the same in a tight grip preventing movement of the body 12 with respect to the chassis 30 during unwinding of the motor 26.

The front wheel 20 is pivotally mounted to the chassis 30 via an axle 46. The axle 46 passes through appropriate holes not identified or shown in the drawings, located in a section 48 of the chassis 30 which is located over the front wheel 20 and is integrally formed with the remainder of the chassis 30. The orientation of the axle 46, and thus the front wheel 20 is at an angle with respect to the longitudinal direction of the chassis 30 such that the front wheel 20 will guide the vehicle 10 in somewhat of a circular path when it is moving across the support surface.

The motor case 32 is appropriately mounted in chassis 30 such that the left and right rear wheels 22 and 24 extend downwardly beneath the bottom of the chassis 30 and can contact a support surface. The placement of the motor case 32 within the chassis 30, in conjunction with the diameter of the left and right rear wheels 22 and 24, compare to the height of the left and right side ornamental wheel sections 16 and 18 is such that the sections 16 and 18 are suspended above the support surface when the rear wheels 22 and 24 support the chassis upwardly from the support surface as is evident from FIG. 7. During forward movement of the vehicle 10, the vehicle 10 is thus supported above the support surface via front wheel 20 and the rear wheels 22 and 24, with the lowermost periphery of the sections 16 and 18 suspended above the support surface.

The body 12 is slidably mounted with respect to the chassis 30 via a front support shaft 50 and a rear support shaft 52 which are appropriately journaled in bearing surfaces 54 and 56 formed in the chassis 30. This allows upward and downward movement of the body 12 with respect to the chassis 30. A screw 58 fits into a boss 60. The boss 60 passes through an opening 62 in the chassis 30. The head of the screw 58 is larger than the opening 62, thus preventing complete withdrawal of the body 12 with respect to the chassis 30. The boss 60 however, is free to move within the opening 62, allowing for the upward and downward movement of the body 12 with respect to the chassis 30.

The interior of the chassis 30 is hollow and the chassis itself is composed of a lower plate 64 and an upper plate 66 which mate with each other after the appropriate components located therein are placed within their interior during assembly of the vehicle 10.

The disk member 42 includes a first flange 68 and a second flange 70 located on its surfaces. Both of the flanges 68 and 70 are arcuately shaped surfaces and extend around a portion of the disk member 42. The flange 68 is located on the outside of the disk member 42 towards the knurled knob 14, while the flange 70 is located on the inside of the disk member 42 toward the motor case 32. The flange 68 is essentially shaped as a semicircular arc, whereas the flange 70, for the most part shaped as a semicircular arc, also includes a section 72 which is bent inwardly and joins the remainder of the flange 70 in a smooth curve at the point 74. Both of the flanges 68 and 70 are integrally formed with the disk member 42 and rotate in conjunction with rotation of the disk member 42.

Figure 2:
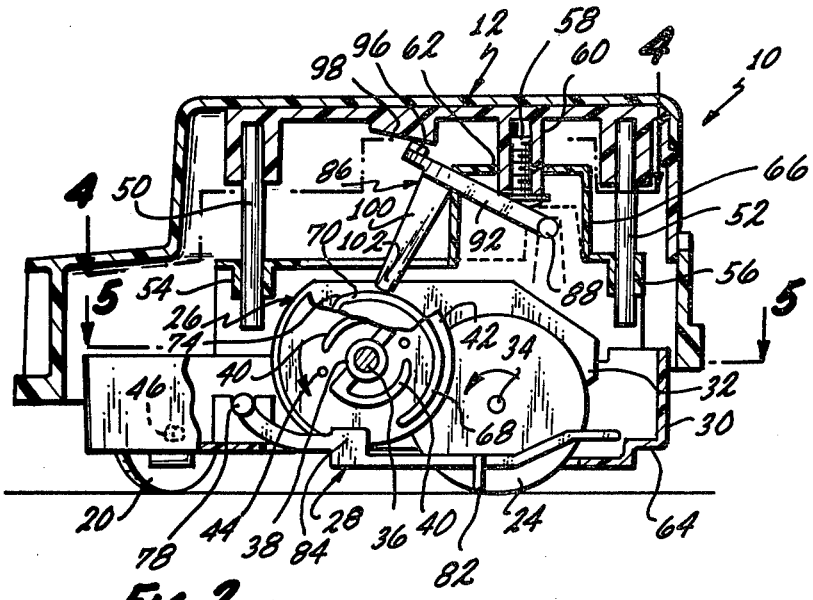
FIG. 2 is a side elevational view in partial section of the toy vehicle of FIG. 1.

The lever 28 is pivotally mounted via an axle 78 inside of the chassis 30 by locating the axle 78 within two ears collectively identified by the numeral 80 formed on the lower chassis plate 64. The lever 28 includes a small projection 82 located on its underneath surface. The projection 82 is located in conjunction with the left and right rear wheels 22 and 24. A cam surface 84 on the lever 28 is located in association with the first flange 68. As the first flange 68 rotates, it engages the cam surface 84. When it is engaged against the cam surface 84, it pivots the lever 28 about its axle 78 such that the projection 82 extends downwardly below the bottommost periphery of the rear wheels 22 and 24, lifting the rear wheels 22 and 24 above the support surface such that they no longer engage the support surface and they no longer drive the vehicle 10 forward. When the flange 68 is located with respect to the cam surface 84 as seen in FIG. 2, the cam surface 84 does not contact the flange 68 and thus the flange 68 does not press downwardly against the lever 28 allowing for the weight of the vehicle to push down on the rear wheels 22 and 24, lifting the lever 28 upwardly within the chassis 30 such that the rear wheels 22 and 24 contact the support surface and the vehicle 10 is driven forward on the support surface via the rotation of these rear wheels 22 and 24 in response to rotation of the rear wheels 22 and 24 by the spring motor 26.

Figure 6:
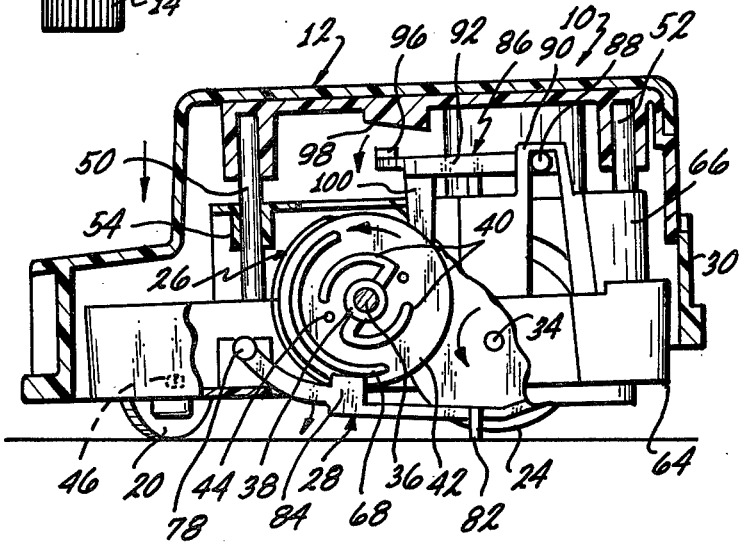
FIG. 6 is a side elevational view similar to FIG. 2 with certain of the components of the invention in a different spatial relationship with respect to one another than as seen in FIG. 2.
Figure 6A:
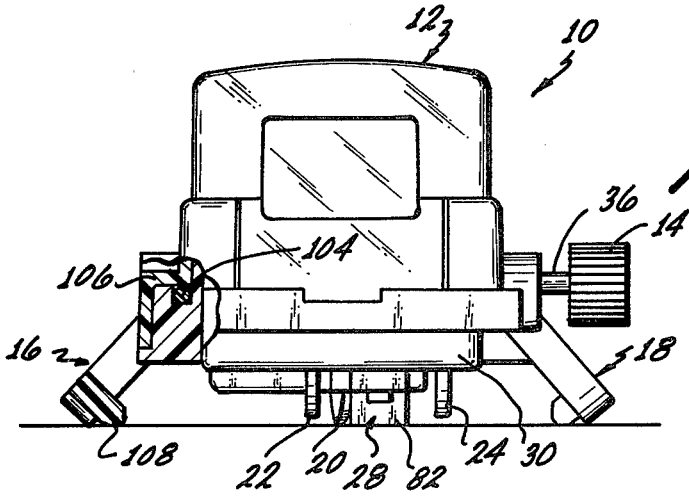
FIG. 6*a* is a rear elevational view in partial section with the components located therein in the same spatial relationship as they would be in FIG. 6.
Figure 5:
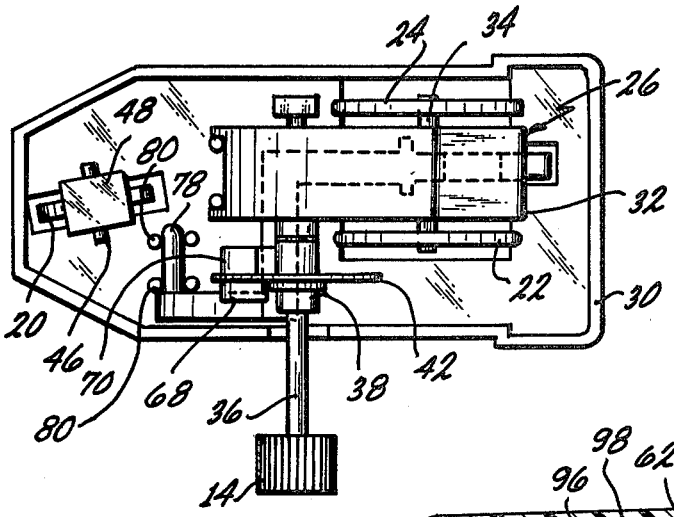
FIG. 5 is a plan view about the lines 5—5 of FIG. 4.
Figure 7:
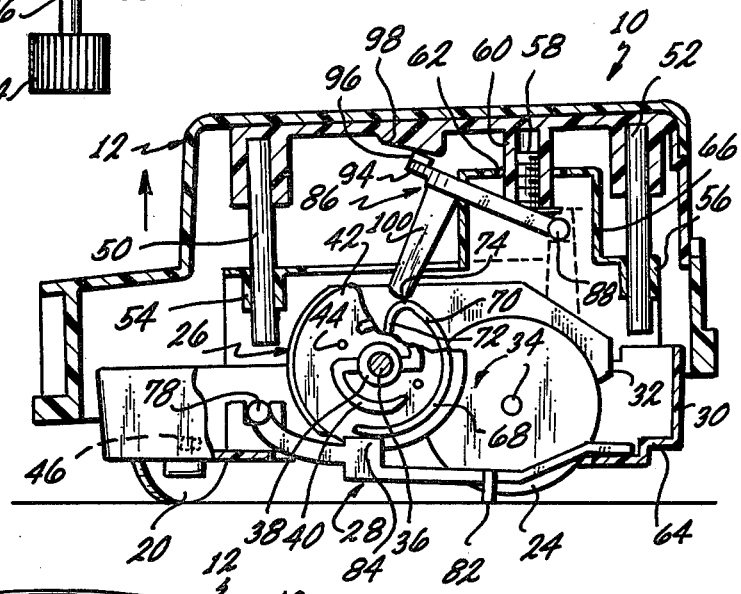
FIG. 7 is a side elevational view similar to FIG. 6 with certain of the components in a different spatial relationship than as seen in FIG. 6.
Figure 7A:
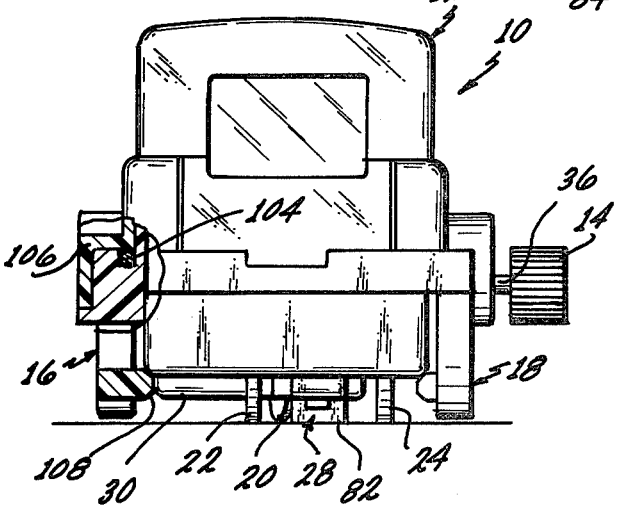
FIG. 7*a* is a rear end elevational view similar to FIG. 6*a* except that the vehicle is in the same spatial relationship as seen in FIG. 7.

As seen in FIG. 6, as the disk member 42 rotates, the flange 68 engages the cam surface 84 on the lever 28 and extends the projection 82 downwardly with respect to the chassis 30, raising the rear wheels 22 and 24. In moving from FIG. 6 to FIG. 7, continued rotation of the disk member 42 then locates the cam surface 84 on the very end of the flange 68. At this time the rear wheels 22 and 24 are still raised above the support surface. However, as soon as the disk member 42 has rotated several more degrees counterclockwise, as seen in FIG. 7, the cam surface 84 is no longer in contact with the flange 68 and the weight of the vehicle 10 then causes the rear wheels 22 and 24 to descend to engage the support surface.

A member 86 is pivotally mounted to the upper chassis plate 66 via two short axle sections collectively identified by the numeral 88 located thereon, which fit into two bearing surfaces collectively identified by the numeral 90 which are integrally formed on the upper chassis plate 66. The member 86 includes an arm 92 located on either of its sides which terminates in the axles sections 88. The arms 92 are joined by cross member 94 which carries on it a small projection 96. The projection 96 is located in association with a wedge-shaped projection 98 located on the inside of the top of the body 12. The projection 96 can slide against the wedge-shaped projection 98 as hereinafter explained.

Member 86 also includes a downwardly projecting arm 100. Together, the arm 100 and the arms 92 form a bent lever structure, as is evident in side elevation in FIGS. 2, 6 and 7. The end 102 of arm 100 is positioned to engage the flange 70 located on the disk member 42. As the disk member 42 rotates counterclockwise, the end 102 of the arm 100 rides against the flange 70. At all times when the end 102 is engaged against the flange 70, the member 86 is pivoted upwardly about its axles 88 such that the projection 96 engages the projection 98 and holds the body 12 in an upward position with respect to the chassis 30.

Figure 3:
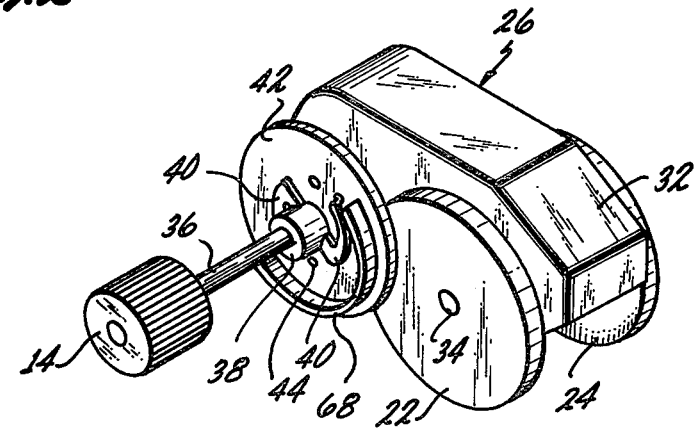
FIG. 3 is an oblique view of the motor and a portion of the driving mechanism of the toy vehicle of FIG. 1.
Figure 4:
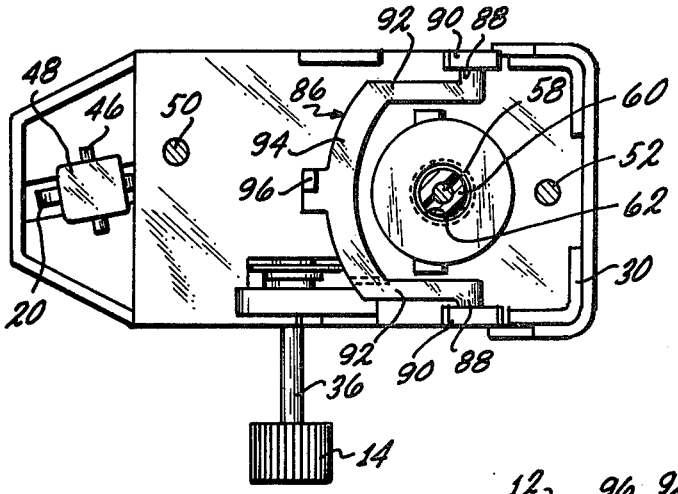
FIG. 4 is a top plan view about the line 4—4 of FIG. 2.

When the disk member 42 is rotated in a position as is seen in FIG. 6 such that the flange 70 is not in position to engage the end 102 of arm 100, the member 86 rotates counterclockwise about its axle 88 such that it moves into the position as seen in FIG. 6 and disengages the projection 96 against the projection 98 of the body 12. This allows the body 12 to descend downwardly with respect to the chassis 30. As the disk member 42 rotates counterclockwise from the position as seen in FIG. 6 to that seen in FIG. 7, the section 72 of the flange 70 engages the end 102 of the arm 100 and as the end 102 of the arm 100 rides across this section 72 it comes upwardly around the rounded point 74 of the flange 70, rotating the member 86 clockwise about its axles 88 which lifts the projections 96 until it engages the wedge-shaped projection 98 on the body 12. Continued counterclockwise rotation of the disk member 42 then engages the end 102 of the arm 100 onto the surface of the flange 70 which maintains the body 12 in an upright position as is seen in FIG. 3. In FIG. 7, engagement of the end 102 of the arm 100 against the rounded section about point 74 on the flange 70 is illustrated. At this time, the body 12 is starting to raise with respect to the chassis 30 from the orientation as seen in FIG. 6 to the orientation as seen in FIG. 7 and continued rotation in a counterclockwise manner of disk member 42 completely raises the body 12 with respect to the chassis 30 such that the body 12 is located as is seen in FIGS. 2 and 1.

When the disk member 42 is rotated such that the flange 70 is no longer located with respect to the end 102 of the arm 100, it allows for rotation of the member 86 about its axle 88 as described above, with the lowering of the body 12 with respect to the chassis 30. This event happens concurrently with the engagement of the cam surface 84 on the lever 28 with the flange 68. Thus, as the body 12 is lowered with respect to the chassis 30 the rear wheels 22 and 24 are raised upwardly from the support surface and with the lowering of the body 12 on the chassis 30, the vehicle 10 is no longer driven in the forward direction.

When the end 102 of the arm 100 engages the flange 70, the cam surface 84 on the lever 28 disengages the flange 68 and as the body 12 is raised with respect to the chassis 30 the vehicle 10 is lowered downwardly toward the support surface such that the rear wheels 22 and 24 engage the support surface. Thus, when the body 12 is in its upper position with respect to the chassis 30, the rear wheels 22 and 24 are engaged with the support surface and the vehicle is driven forward by the rear wheels 22 and 24.

The left and right side ornamental wheel sections 16 and 18 are both identically pivotally mounted to the body 12. The mounting of these is illustrated for the left side 16 in FIGS. *6a* and *7a*. The right side ornamental wheel section 18 is identically pivoted to the body 12. The left side section 16 includes an axle 104 which is appropriately journaled within the sidewall 106 of the body 12. Both of the sections 16 and 18 include a small inwardly projecting, elongated, wedge-shaped flange 108 located on their inner side. As the body 12 descends with respect to the chassis 30, the left and right side ornamental wheel sections 16 and 18 engage the support surface and the wedge-shaped flanges 108 contact the support surface and direct the downward portion of the sections 16 and 18 outwardly with respect to the remainder of the body 12. This causes the sections 16 and 18 to assume the orientation as seen in FIG. *6a*. It will be remembered that at this time the projection 82 on the lever 28 has engaged the support surface and the left and right hand rear wheels 22 and 24 have been raised with respect to that support surface. Upon raising of the body 12 with respect to the chassis 30, the left and right side ornamental wheel sections 16 and 18 are raised upwardly from the support surface, and under the influence of gravity they are moved inwardly such that they hang directly downwardly from the body 12 as seen in FIG. *7a*. Thus, in FIG. *7a* the sections 16 and 18 are in a perpendicular orientation with respect to the support surface and in FIG. *6a* the sections 16 and 18 are in a prolapsed orientation with respect to the support surface.

We claim:

1. A toy vehicle which comprises:

a chassis, said chassis including a plurality of wheels rotatably mounted thereon, at least one of said wheels being a driving wheel;

a vehicular body movably mounted on said chassis so as to move vertically up and down relative to said chassis between a raised position and a lowered position;

a motor located on said chassis, said driving wheel operatively connected to said motor and rotated with respect to said chassis by said motor;

control means mounted on said chassis in operative association with said motor, said control means for cyclically first postioning said vehicular body in one of said raised and said lowered positions relative to said chassis and engaging said driving wheel with a support surface so as to propel said vehicle across said support surface and secondly positioning said vehicular body in the other of said raised and said lowered position with respect to said chassis and disengaging said driving wheel from said support surface so as to maintain said vehicle relatively stationary with respect to said support surface.

2. The toy vehicle of claim 1 wherein:

when said driving wheel propels said vehicle across said support surface said vehicular body is located in said raised position with respect to said chassis.

3. The toy vehicle of claim 2 wherein:

said control means includes motion retarding means located on said chassis in association with said driving wheel, said motion retarding means for retarding the motion of said vehicle with respect to said support surface when said vehicular body is in said lowered position.

4. The toy of claim 3 wherein:

said control means includes vehicular body elevating means operatively connecting between said chassis and said vehicular body, said vehicular body elevating means for moving said vehicular body with respect to said chassis between said raised and said lowered positions.

5. The toy vehicle of claim 4 wherein:

said vehicular body includes a body section and a left and right side ornamental wheel section, said left and right side ornamental wheel section movably mounted on said body section and capable of assuming an essentially vertical position with respect to said support surface when said vehicular body is in said raised position and a prolapsed position with respect to said support surface when said vehicular body is in said lowered position.

6. The toy vehicle of claim 5 wherein:

said motion retarding means includes a first lever means pivotally mounted on said chassis and including an end of said first lever means located in conjunction with said driving wheel, said end of said first lever means capable of descending downwardly from said chassis and contacting said support surface to lift said driving wheel from operative contact with said support surface and moving upwardly away from said support surface allowing said driving wheel to operatively contact said support surface.

7. The toy vehicle of claim 6 wherein:

said vehicular body elevating means includes a second lever means pivotally mounted on said chassis and having a portion thereof located in conjunction with said body section, said portion capable of contacting said body section and raising said body section with respect to said chassis in response to pivoting of said second lever means in a first direction with respect to said chassis and lowering said body section with respect to said chassis in response to said pivoting of said second layer means in a second direction opposite of the first direction.

8. The toy vehicle of claim 7 wherein:

said second lever means comprises in part a bent lever having first and second joined arms, said bent lever pivotally mounted on said chassis about the end of one of its arms and contacting said body section at a point proximal to the junction at its arms.

9. The toy vehicle of claim 8 wherein:

said control means includes a rotating member rotatably mounted in said chassis and having a first and a second arcuately shaped contact surface located thereon, one of said contact surfaces contacting the end of the other of said arms of said bent lever to raise and lower said body section and the other of said contact surfaces contacting said first lever means to raise and lower said driving wheel with respect to said support surface.

10. The toy vehicle of claim 9 wherein:

said rotating member comprises a circular member mounted in association with said motor and rotated by said motor, said circular member including a first and second essentially semi-circular flange mounted on said circular member so as to rotate in a circular pathway with respect to rotation of said circular member, said first and said second flanges located on said circular member such that one of said flanges extends approximately 180° around one side of said circular member and the other of said flanges extends approximately 180° around the other side of said circular member, said first lever means contacting said one of said flanges and said second lever means contacting the other of said flanges.

* * * * *